US007788750B2

(12) United States Patent
Norstrem

(10) Patent No.: US 7,788,750 B2
(45) Date of Patent: Sep. 7, 2010

(54) MULTI-FUNCTION CERVICAL PILLOW

(75) Inventor: Paul R. Norstrem, Dresser, WI (US)

(73) Assignee: Core Products International Inc., Osceola, WI (US)

( * ) Notice: Subject to any disclaimer, the term of this patent is extended or adjusted under 35 U.S.C. 154(b) by 210 days.

(21) Appl. No.: 11/573,023

(22) PCT Filed: Aug. 5, 2005

(86) PCT No.: PCT/US2005/028045

§ 371 (c)(1),
(2), (4) Date: Nov. 25, 2008

(87) PCT Pub. No.: WO2006/020545

PCT Pub. Date: Feb. 23, 2006

(65) Prior Publication Data

US 2009/0211030 A1 Aug. 27, 2009

Related U.S. Application Data

(60) Provisional application No. 60/600,035, filed on Aug. 9, 2004.

(51) Int. Cl.
*A47G 9/10* (2006.01)

(52) U.S. Cl. ..... 5/644; 5/645; 5/640

(58) Field of Classification Search ..... 5/636, 5/639, 640, 643–645, 490, 738
See application file for complete search history.

(56) References Cited

U.S. PATENT DOCUMENTS

| | | | | |
|---|---|---|---|---|
| 3,148,389 | A * | 9/1964 | Lustig |
| 4,754,513 | A * | 7/1988 | Rinz |
| 5,016,303 | A * | 5/1991 | Tanaka et al. |
| 5,367,731 | A * | 11/1994 | O'Sullivan |
| 5,819,347 | A * | 10/1998 | Masuda |
| 6,047,425 | A * | 4/2000 | Khazaal |
| 6,910,237 | B2 * | 6/2005 | DiGirolamo |
| 6,931,682 | B2 * | 8/2005 | Kruger, Jr. |
| 6,988,286 | B2 * | 1/2006 | Schecter et al. |
| 7,017,214 | B2 * | 3/2006 | Bard |
| 7,152,263 | B1 * | 12/2006 | Delfs |

* cited by examiner

*Primary Examiner*—Michael Trettel
(74) *Attorney, Agent, or Firm*—Nawrocki, Rooney & Sivertson, P.A.

(57) ABSTRACT

A multi-function pillow for therapeutic neck and head support is provided. The pillow generally includes first and second pillow sides united so as to form a sealable pillow cavity, and fluid retaining and neck support elements receivable within the cavity. The first pillow side includes a chamber containing a fill material therethrough. The second pillow side includes at least two chambers, at least one chamber of the at least two chambers containing a fill material therethrough, and one chamber of the at least two chambers defining a central depression for the second pillow side. The fluid retaining element, which is substantially co-extensive with the pillow sides, includes a fluid chamber circumscribing a central region thereof which is to underlie the central depression of the second pillow side.

33 Claims, 3 Drawing Sheets

MULTI-FUNCTION CERVICAL PILLOW

This is an international patent application filed under 35 U.S.C. §363 claiming priority under 35 U.S.C. §119(e) (1), of provisional application Ser. No. 60/600,035 having a filing date of Aug. 9, 2004.

TECHNICAL FIELD

The present invention generally relates to a contour pillow, more particularly, to a multi-function cervical pillow characterized by a variable support functionality in furtherance of accommodating several stages of treatment and/or recuperative therapy.

BACKGROUND OF THE INVENTION

A wide variety of pillows and pads for supporting the head, neck and other parts of the body are well known. Traditionally, and typically, a pillow consists of an envelope filled with a soft material, such as down, spun fibers, foam rubber and the like. While these pillows are intended to provide comfort during rest/sleep, they tend to orient the head of a person so as to misalign the head, neck, and spine, with such misalignment often times resulting in physical manifestations of discomfort and/or pain. It is generally believed advantageous to provide a pillow having more/increased support in the neck area as a higher degree of neck support relative to head support helps to relieve pain and improve the rate of healing of certain injuries, owing to a reduction in mechanical stress on the muscles, tendons, nerve roots and other soft tissue structures in and around the spinal column.

In furtherance of providing different degrees of support for the head and neck, one approach has been to construct pillows using fillers consisting of synthetic fibers, feathers, or down of various densities and fullness, with special shapes formed in the pillow, usually by sewing the cover to form hollow sections or compartments. Such pillows however are typically designed with a top surface having a fixed shape or configuration, and as such, they are not adjustable to suit different users, especially well suited for treating different problems, nor do they allow the flow of filler material from areas on which high external pressures are imposed by the body to lower pressure areas which are more lightly loaded by different parts of the body.

A further known style of pillow intended to provide varying degrees of support for the head and neck utilize a foam rubber core of a select resilience, preformed to a desired shape and size. Such pillows of this style are also known to employ replaceable foam inserts or the like. Again, such designs lack a advantageous adaptability or versatility in furtherance of providing varying degrees of functionality.

Beyond those heretofore described, contourable pillows have also been designed so as to have air permeable and air impermeable envelopes, chambers, or compartments (e.g., U.S. Pat. No. 3,864,766) as well as multiple, parallel chambers in fluid communication with each other (e.g., U.S. Pat. Nos. 5,642,544 and 5,898,963). Lacking a structured media, or a substantial structured media, such designs and/or configurations fail to sufficiently maintain the sought after contour due to a general dynamic condition for the fluid of the fluid filled chambers.

As is also well known, contourable pillows have also been designed so as to have means to alter chamber configurations to suit individual needs (e.g., U.S. Pat. No. 5,363,524). With such pillows, users must estimate the desired contour and then manually manipulate the fill material which, as in the fluid filled compartment styles, can be less than optimal when compared to structured pillow arrangements. An overview of further known styles of contourable pillows follows.

U.S. Pat. No. 5,771,514 (Wilhoit) is generally directed to an adjustable contour pillow wherein one or more chambers thereof may be selectively inflated, via a controller assembly integral with the pillow, so as to suit the particular needs of a given individual. Additional features contemplated include heating and/or massage means.

U.S. Pat. No. 5,367,731 (O'Sullivan) is generally directed to a two-sided therapy pillow readily adapted so as to provide different degrees of support to a user's neck. Generally, two styles of pillow structure are disclosed, namely, those including one or more compartments, and those without compartments. It is contemplated that inserts may be selectively received in one or more of the several compartments to change the elevation and curvature of separate regions of the pillow, and/or to provide hot/cold therapy.

U.S. Pat. No. 4,768,248 (O'Sullivan) is generally directed to a "health" pillow characterized by dual chambers. A soft filler material is included within a first chamber for supporting the head, whereas a firm neck support element is slidably movable within a second chamber for easy shifting thereof from one select position to another within the chamber.

U.S. Pat. No. 4,756,035 (Beier) is generally directed to an orthopedic pillow having dual compartments. A fibrous material is contained within a first compartment to provide a head cushion, with an elongate resilient block receivable within a second compartment of the pillow. Advantageously, the resilient block may be readily adapted via substitution of components or elements thereof in furtherance of achieving increased/decreased firmness therefore.

U.S. Pat. No. 4,724,560 (Christien) is generally directed to a pillow, adapted to provide yieldable support of controllable softness and thickness, characterized by a central air compartment surrounded by a continuous liquid compartment. Both the air and water chambers are critically noted as being continuous and coextensive.

Finally, U.S. Pat. No. 4,247,963 (Reddi) is generally directed to a liquid-filled laminate support member wherein an air compartment is interposed between opposingly paired liquid compartments.

In light of the foregoing, there remains a need to provide a contour or contourable pillow suitable for accommodation, correction, and maintenance of the proper physiology of the head, neck and spine. It is further believed advantageous to provide a cervical pillow characterized by a soft semi-structured outer jacket, and one or more internal structured, semi-structured and/or free flow elements.

SUMMARY OF THE INVENTION

The multi-function cervical pillow of the subject invention is intended to accommodate, correct, and maintain the proper physiology of the head, neck and spine. Objectives of the intended stages are to: help relieve pain and/or discomfort by conforming to and stabilizing an existing condition (accommodate stage); help eliminate symptoms by helping treat the cause of the condition (corrective stage); and, ensure continued good health by sustaining the body in its proper, natural state/configuration (maintenance stage).

In furtherance thereof, the multi-function cervical pillow of the subject invention advantageously includes an outer jacket having two discrete cells containing a resilient, compressible fill material, such as polyester fiber, each cell having a soft fabric exterior surface. The two cells of the outer jacket are generally integrated at their periphery so as to form a closeable interior space between the cells. A fluid fillable bladder and bolster are further provided for selective inclusion, via receipt within the interior space of the outer jacket, to provide a pillow having a user select thickness and/or firmness. While the bladder may be selectively filled to various degrees of thickness/firmness the bolster may be selectively incorporated so as to assist the restoration of a proper rest/sleep alignment for the head, neck and spine.

The subject pillow provides a heretofore unseen versatility in furtherance of providing proper support and comfort to a wide variety of user suffering from a wide array of neck, head, or spine maladies. The following illustrative examples are provided, and are not intended to be limiting: as a conventional sleep pillow via use of the outer jacket alone; as a therapeutic comfort pillow via the combination of the outer jacket with the fluid fillable bladder; as a therapeutic treatment pillow by the addition of the bolster to the therapeutic comfort pillow described; and, as a neck health maintenance pillow via the combination of the outer jacket with the bolster. Furthermore, the level of support can be user/regulated by increasing/decreasing the amount (volume) of fluid contained in the fluid fillable bladder, and/or inverting, i.e. flipping, the outer jacket to selectively place one of the two discrete cells in a position to directly underlie the head/neck, or, above/below the other selectively integrated components or elements. More specific features and advantages obtained in view of those features will become apparent with reference to the drawing figures and DETAILED DESCRIPTION OF THE INVENTION.

BRIEF DESCRIPTION OF THE DRAWINGS

Referring now to the drawings wherein like numerals are used to designate like parts of the invention throughout the figures.

DETAILED DESCRIPTION OF THE INVENTION

Figure 1:
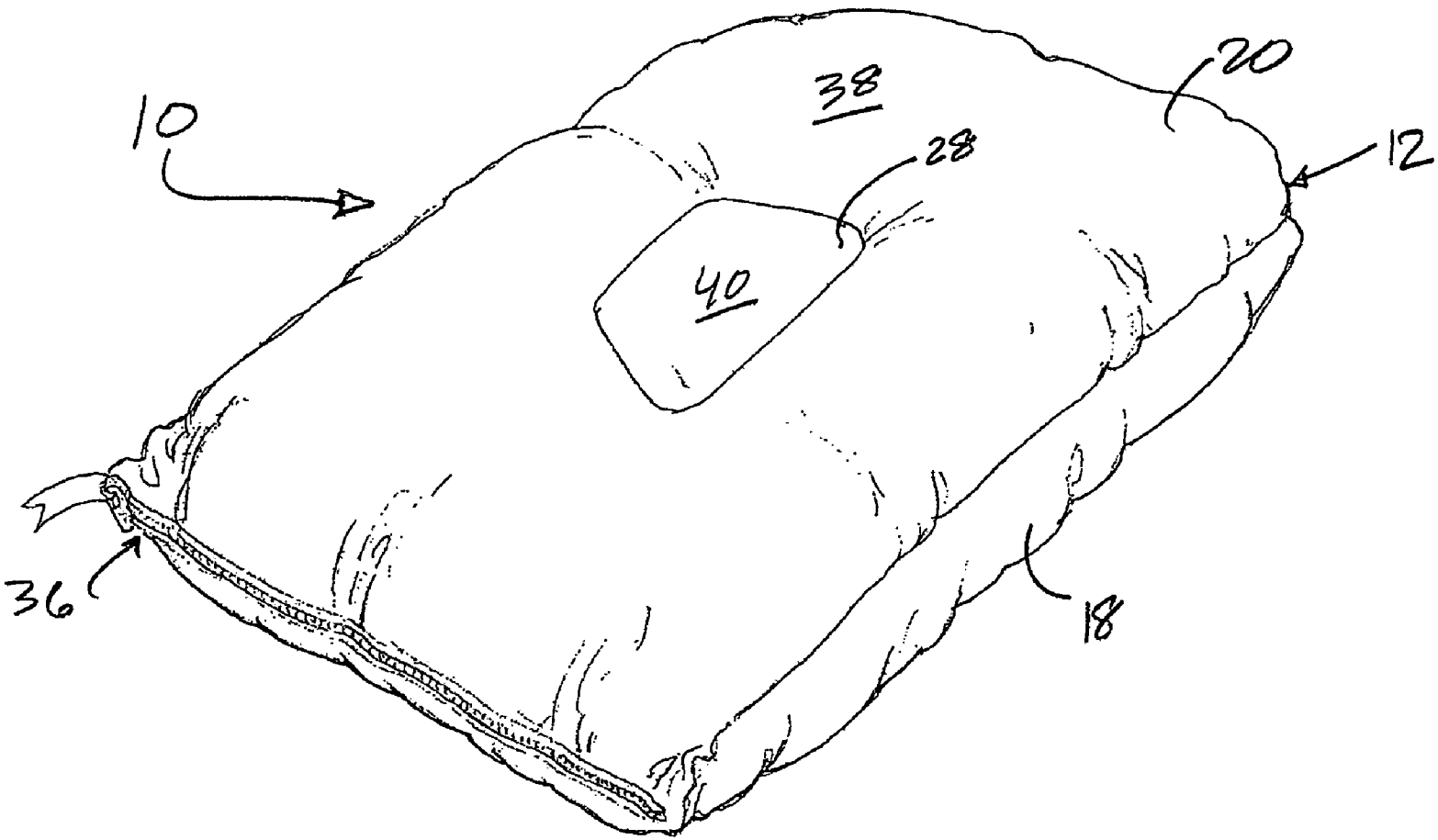
FIG. 1 is a perspective view, slight from above, illustrating a pillow shell, and sections thereof, of the multi-function cervical pillow of the subject invention.
Figure 2:
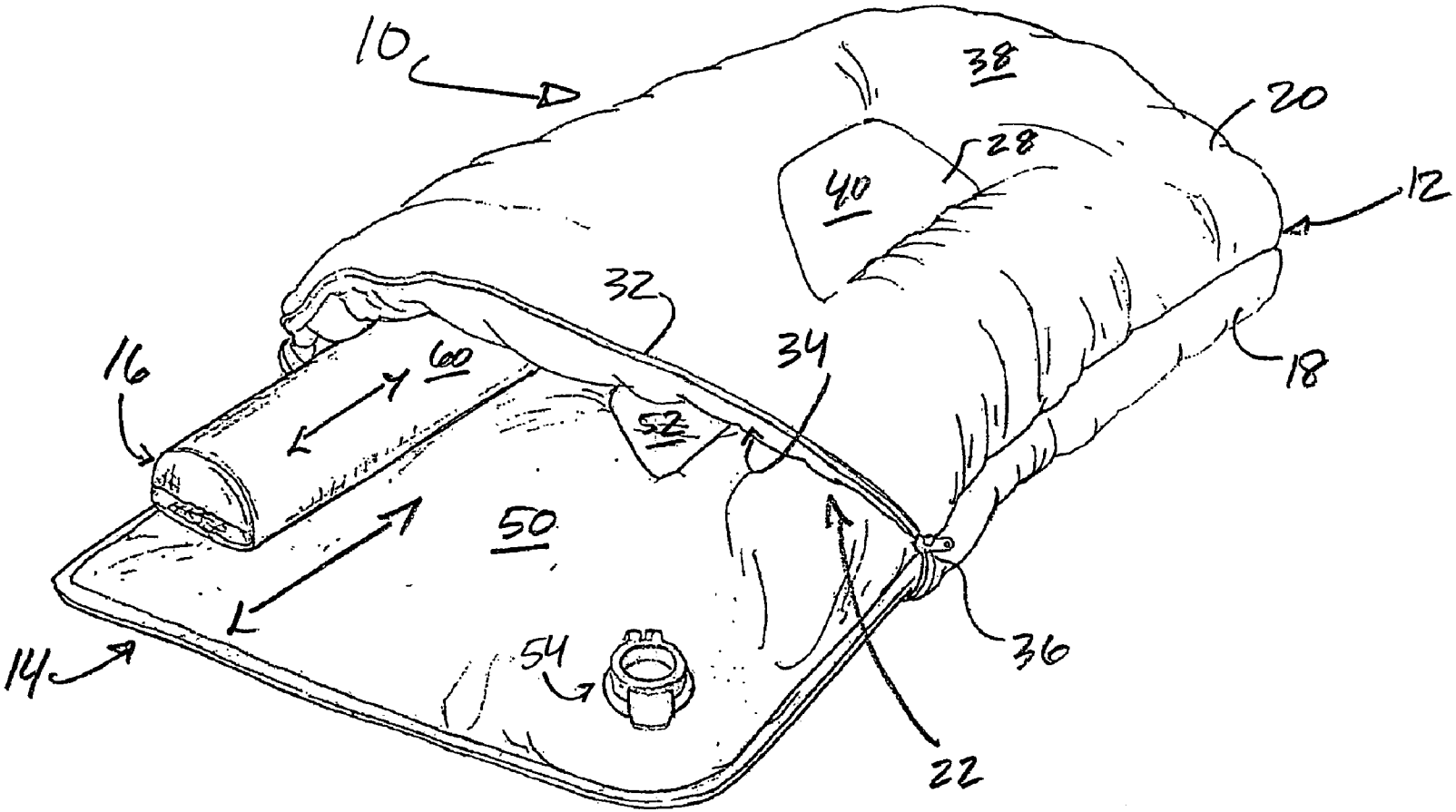
FIG. 2 is a view as FIG. 1 depicting fluid fillable and bolster inserts, for selective discrete or combined integration with the pillow shell of FIG. 1; and, FIG. 3 is a lateral cross section of the pillow shell of FIG. 1 equipped with the inserts of FIG. 2 in combination.
Figure 3:
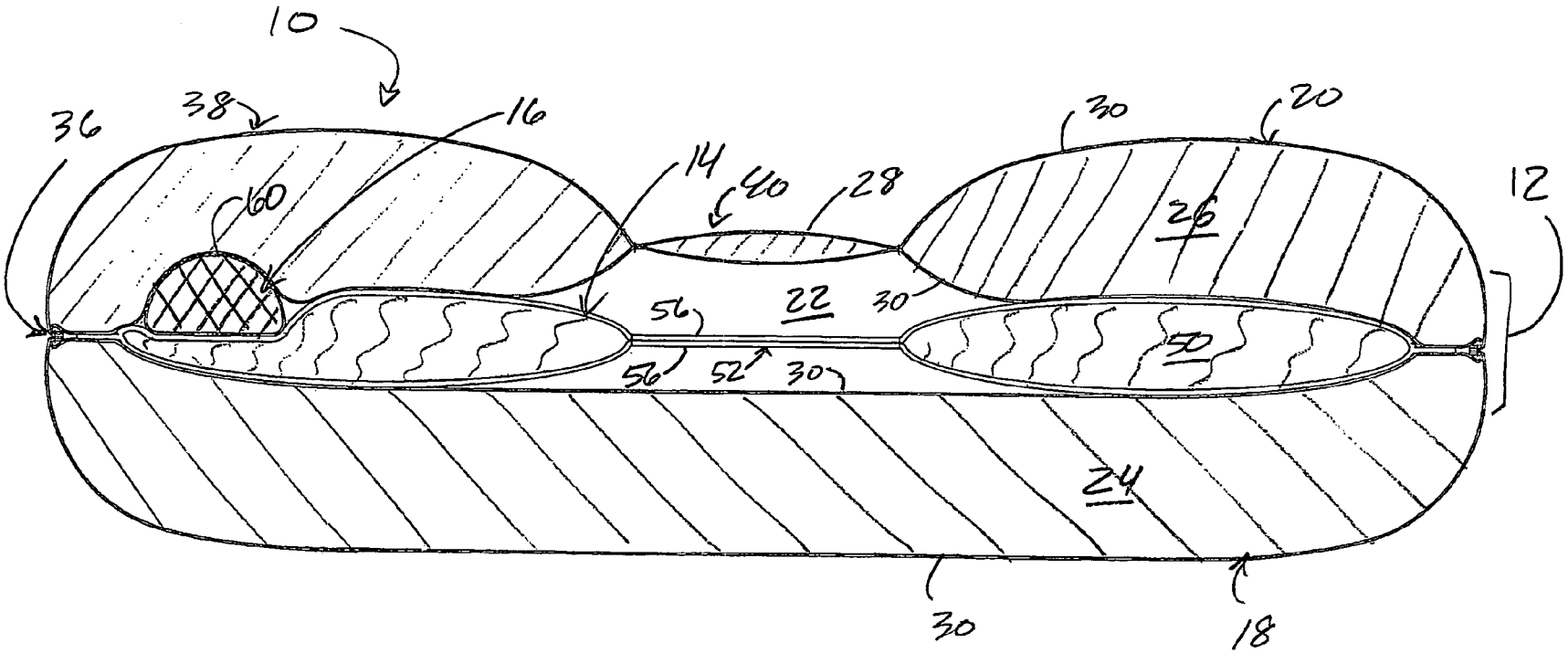

With general reference to FIGS. 1-3, the multi-function cervical pillow 10 of the subject invention generally includes a pillow shell 12 (FIG. 1), and advantageously further, but not necessarily, includes either a fluid fillable insert 14 (e.g., a bladder), a bolster insert 16, or a combination of the inserts (FIGS. 2 & 3). With a "mix and match" strategy or approach, the pillow shell, alone or in select combination with one or both of the subsidiary elements of the subject invention, supremely addresses accommodation, correction, and/or maintenance of the proper physiology of the head, neck and spine during rest or sleep.

With particular reference to FIGS. 1 & 3, the two-sided pillow shell or jacket 12 generally includes first 18 and second 20 pillow sections or panels united so as to form an accessible interior space or pocket 22 (FIG. 2, see also FIG. 3). The first pillow section 18 has a fill material 24 contained therein and therethrough, while the second pillow section 20 also has fill material 26 contained therein, and includes a central depression 28 to aid proper positioning of the head and neck with respect to the jacket or shell 12.

Each of the shell portions, i.e., each of the first 18 and second 20 pillow sections, generally comprise opposingly paired sheets 30, more particularly and preferably, fabric sheets, e.g., a high thread count, 200+, 100% cotton sheet, which are generally united, e.g., as by stitching, adjacent peripheral edges thereof. As illustrated, the overall configuration of the pillow of the subject invention is advantageously, but not necessarily, rectangular, i.e., elongate, each of the opposingly paired sheets 30 being of like or conforming configuration.

As previously noted, each of the shell portions 18, 20 are in turn advantageously united at three of four of their edges, e.g., opposing longitudinal side edges and one of two opposing lateral side edges, as shown, so as to form or delimit the accessible interior space or cavity 22 for the shell 12 (FIG. 2). Opposing free lateral edges 32 of each of the shell portions 18, 20 define a mouth 34 for the shell 12 through which the one or more inserts of the subject invention pass for receipt within the interior space 22. Each of the opposing free lateral edges 32 of each of the shell portions 18, 20 is preferably equipped with components of a fastening system, e.g., a zipper 36 as shown (FIGS. 1 & 2), hooks/loops, snaps, buttons, lacing, etc., to enable reversible closure of the mouth 34 so as to thereby retain the one or more inserts contemplated.

The "first" pillow section 18 of the shell 12 is advantageously a low loft chamber, that is to say, the first pillow section comprises a single chamber containing fill material 24 whose quality, character and/or amount contributes to a less firm tactile experience in comparison to that associated with the second pillow section. Preferably, but not necessarily, the fill material 24 is a resilient synthetic fiber, e.g., polyester, however, a variety of heretofore known natural or synthetic fillings are likewise contemplated and suitable.

The "second" pillow section 20 of the shell 12 is advantageously a high loft chamber and includes central depression 28 (FIG. 3) formed by the select union of superimposed central regions of the opposingly paired sheets 30 comprising same. Although preferably configured as a trapezoid (FIG. 1), the depressed central region 28 of the second pillow 20 may suitably be configured as a square, rectangle, triangle, circle, oval, etc. With such construction, the second pillow section 20 delimits two chamber portions, more particularly, neck 38 and head 40 chamber portions, at least one of which, i.e., the neck portion 38, contains fill material 26. Advantageously, and as illustrated (FIG. 3), the head chamber portion 40 likewise includes fill material 26, albeit to a much lesser degree than that associated with the neck chamber portion 38, and preferably, but not necessarily, the fill material 26 of the high loft chamber is identical to that of the low loft chamber (i.e., fill material 24), only "packed" at a greater density in the high loft chamber, more particularly, the neck chamber portion.

Prior to a discussion of the inserts, a discussion of shell functionality is appropriate. The two-sided pillow jacket 12 is particularly and inherently suited for providing two different degrees of support to a user's neck, namely, a first degree of support for a user's neck when the first panel or side 18 is used, and a second degree of support when the second panel or side 20 is used.

Specifically, when a user rests his or her head on the jacket side characterized by the second panel 20, the user's head rests directly within the central depression 28 thereof. The part of the jacket's second panel just outside the depression 28, i.e., contiguous therewith or adjacent thereto namely, the neck chamber portion 38 thereof, makes firm contact with the user's neck, and provides support thereto. When the jacket 12 is used in this manner, maximum support is provided to the neck.

Should a user desire a smaller amount of support to his or her neck, the jacket's side characterized by the first panel 18 may be used. When the user rests his or her head in a central region or portion of the first jacket side 18, the user's head rests indirectly within the central depression 28 of the second side, i.e., panel 20, and thusly sinks into the jacket 12 to a lesser extent than when the second side 20 directly receives the head/neck, but nonetheless more than when a conventional pillow is used. The user's head sinks more than in a conventional pillow because the central depression 28 of the second panel 20 underlies the user's head on the opposite side of the jacket 12. The presence of a central depression in one of the jacket panels, e.g., the second panel as shown, reduces the amount of support given to the user's head by the jacket. Because the user's head sinks into the first side of the jacket a small amount, the side portions of the jacket come into contact with the user's neck to give support thereto. However, as previously noted, this contact is not as firm as when the second panel of the jacket is used.

Many users find the reduced support of the jacket's first side more comfortable during certain times, but at other times, the same users may prefer the firmer support given by the jacket's second side. Thus, the pillow jacket allows the user to adjust the amount of support given to his or her neck by simply turning the pillow jacket over to its other side. In furtherance of support adjustment, the pillow shell or jacket 12 of the subject invention may be readily equipped with one or more inserts, namely, the fluid fillable insert 14 and/or the bolster 16 insert.

The fluid fillable insert 14 includes at least a single fluid chamber 50, surrounding a central portion or region 52 thereof (FIGS. 2 & 3), and a fluid ingress/egress port 54. Although not shown, the chamber 50 may optionally include baffles or compartments, or the insert per se may be readily adapted to include greater than one chamber in furtherance of support and initiation of proper sleep position restoration.

Generally configured and substantially dimensioned as the second pillow section, the fluid retaining element 14 comprises opposingly paired fluid impervious sheets 56, e.g., pliable plastic sheeting, united about their peripheral edges in a known way, with the sheeting further advantageously centrally united so as to delimit a central depression commensurate with the central region 52 upon filling the fluid chamber 50 with fluid (FIG. 3). Advantageously, the central depression resulting from at least partially filling the fluid chamber 50 mimics, dimensionally and geometrically, the central depression 28 of the second pillow section 20, under which it is intended to be deployed (i.e., the fluid chamber 50 corresponds to the neck chamber 38 of the second pillow section 20).

Water is the preferred fluid for filling the fluid filled insert, however, a variety of liquids or gases are also known for such purpose, and believed to be at least suitable substitutes. As should be readily appreciated, a variety of support levels may be achieved, e.g., gentle, regular, and firm, in direct relation to the volume of fluid supplied, and in relation to the compressibility of the fluid. When utilizing warm tap water, and minimizing air entrapment during fill operations, four fluid quarts qualitatively equates to a gentle level of support, with six and eight fluid quarts generally corresponding to regular and firm respectively.

A further insert for selective receipt in the pocket of the pillow shell comprises bolster 16 (FIGS. 2 & 3). The bolster is intended to restore the neck and head to their natural position, more particularly, their optimal physiological alignment. The bolster 16 generally comprises an elongate element having a curved or arcuate surface 60, e.g., a bisected cylinder as illustrated. Advantageously, but not necessarily, the bolster 16 traverses the length of the pillow shell 12, more particularly, the length/depth of the jacket pocket 22, and is preferably but not necessarily, constructed of a resilient material, e.g., polyurethane foam.

Finally, there are other variations of the subject invention, some of which will become obvious to those skilled in the art. It will be understood that this disclosure, in many respects, is only illustrative. Changes may be made in details, particularly in matters of shape, size, material, and arrangement of parts, as the case may be, without exceeding the scope of the invention.

What is claimed is:

1. A cervical support pillow comprising a sealable pillow jacket having united first and second jacket portions and an interior space delimited by said united jacket portions, said interior space selectively accessible via manipulation of components of a fastening system for reversibly uniting segments of said first and second jacket portions, said first jacket portion having a substantially rectangular configuration, a substantially uniform thickness, and a substantially uniform first firmness, said second jacket portion having a substantially rectangular configuration and a non-uniform thickness, said second jacket portion including a central region surrounded by a peripheral region, said peripheral region of said second jacket portion having a substantially uniform second firmness.

2. The cervical support pillow of claim 1 wherein said second firmness is more firm than said first firmness.

3. The cervical support pillow of claim 2 wherein said first jacket portion contains a resilient filling.

4. The cervical support pillow of claim 3 wherein said second jacket portion contains a resilient filling.

5. The cervical support pillow of claim 4 wherein said periphery region of said second jacket portion contains a resilient filling.

6. The cervical support pillow of claim 5 wherein said central region of said second jacket portion contains a resilient filling.

7. The cervical support pillow of claim 3 wherein said periphery region of said second jacket portion contains a resilient filling.

8. The cervical support pillow of claim 7 wherein said central region of said second jacket portion contains a resilient filling.

9. A cervical support pillow comprising a sealable pillow jacket having united first and second jacket portions, an interior space delimited by said united jacket portions, and a fluid fillable bladder, said fluid fillable bladder receivable within said interior space of said cervical support pillow, said first jacket portion having a substantially rectangular configuration, a substantially uniform thickness, and a substantially uniform first firmness, said second jacket portion having a substantially rectangular configuration and a non-uniform thickness, said second jacket portion including a central region surrounded by a peripheral region, said peripheral region of said second jacket portion having a substantially uniform second firmness.

10. The cervical support pillow of claim 9 in combination with a neck bolster, said neck bolster receivable within said interior space of said cervical support pillow.

11. A cervical support pillow comprising a sealable pillow jacket having united first and second jacket portions, an interior space delimited by said united jacket portions, and a neck bolster, said neck bolster receivable within said interior space of said cervical support pillow, said first jacket portion having a substantially rectangular configuration, a substantially uniform thickness, and a substantially uniform first firmness, said second jacket portion having a substantially rectangular configuration and a non-uniform thickness, said second jacket portion including a central region surrounded by a peripheral region, said peripheral region of said second jacket portion having a substantially uniform second firmness.

12. A cervical pillow comprising:

a. a pillow shell having first and second pillow sections united so as to define an accessible shell pocket, said first pillow section having a first fill material contained therein, said second pillow section having a second fill material contained therein and a central depression therein; and, b. a fluid retaining element receivable within said accessible shell pocket, said fluid retaining element comprising a fluid chamber surrounding a central portion of said fluid retaining element.

13. The cervical pillow of claim 12 further comprising a closure for reversibly uniting portions of said first and second pillow sections.

14. The cervical pillow of claim 12 further comprising means for retaining said fluid retaining element within said accessible shell pocket.

15. The cervical pillow of claim 12 wherein a firmness of said first fill material is greater than a firmness of said second fill material.

16. The cervical pillow of claim 12 wherein a firmness of said first fill material is less than a firmness of said second fill material.

17. The cervical pillow of claim 12 further comprising a bolster receivable within said accessible shell pocket.

18. The cervical pillow of claim 17 wherein said bolster substantially traverses a length of said accessible shell pocket.

19. The cervical pillow of claim 17 wherein said bolster comprises a resilient material.

20. The cervical pillow of claim 19 wherein said resilient material comprises polyurethane foam.

21. The cervical pillow of claim 20 wherein said bolster comprises a bisected cylinder.

22. A multi-function pillow for therapeutic neck and head support, said pillow comprising:

a. first and second pillow sides united so as to form a sealable pillow cavity, said first pillow side comprising a chamber containing a fill material therethrough, said second pillow side comprising at least two chambers, at least one chamber of said at least two chambers containing a fill material therethrough, and one chamber of said at least two chambers defining a central depression for said second pillow side;

b. a fluid retaining element, receivable within said sealable pillow cavity and substantially co-extensive with said first and second pillow sides, said fluid retaining element comprising a fluid chamber circumscribing a central region thereof, said central region of said fluid retaining element to underlie said central depression of said second pillow side; and, c. a neck support element receivable within said sealable pillow pocket.

23. The cervical pillow of claim 10 further comprising means for retaining either or both said fluid fillable bladder and said neck bolster within said interior space of said sealable pillow jacket.

24. The cervical pillow of claim 11 wherein said bolster includes a curved surface.

25. The cervical pillow of claim 11 wherein said bolster comprises a bisected cylinder.

26. The cervical pillow of claim 11 wherein said bolster substantially traverses a length of said interior space of said cervical support pillow.

27. The cervical pillow of claim 11 wherein said bolster comprises a resilient material.

28. The cervical pillow of claim 27 wherein said resilient material comprises polyurethane foam.

29. The cervical pillow of claim 12 wherein said pillow shell is characterized by fabric sheets.

30. The cervical pillow of claim 12 wherein said pillow shell is characterized by cotton sheets.

31. The cervical pillow of claim 12 wherein said pillow shell is characterized by cotton sheets having a thread count of at least 200.

32. The cervical pillow of claim 12 wherein said central depression is configured as a trapezoid.

33. The cervical pillow of claim 12 wherein said central depression is configured as an oval.

* * * * *